United States Patent [19]

Sambus

[11] 3,957,182

[45] May 18, 1976

[54] PLEAT FORMING DEVICE

[76] Inventor: Joseph P. Sambus, 1079 Mosefan St., Franklin Square, N.Y. 11010

[22] Filed: July 21, 1975

[21] Appl. No.: 597,764

[52] U.S. Cl. ..... 223/35

[51] Int. Cl.[2] ..... A41H 43/00

[58] Field of Search ..... 223/1, 28–35; 160/348

[56] References Cited

UNITED STATES PATENTS

| | | | |
|---|---|---|---|
| 1,166,174 | 12/1915 | Bisbee | 223/35 |
| 2,660,345 | 11/1953 | Hutchins | 223/33 |
| 2,669,955 | 2/1954 | Gellman | 223/30 X |
| 3,010,621 | 11/1961 | Bonarrigo | 223/31 |
| 3,889,858 | 6/1975 | Hack | 223/35 |

*Primary Examiner*—G. V. LarKin

*Attorney, Agent, or Firm*—Bucknam and Archer

[57] ABSTRACT

A pleat forming device in which material to be pleated is held against one or more blades the edges of which define fold lines in the material spaced in accordance with a predetermined pleating pattern.

9 Claims, 10 Drawing Figures

PLEAT FORMING DEVICE

BACKGROUND AND SUMMARY OF THE INVENTION

In the manufacture of draperies and other sewn fabric articles, it is frequently desired to make a series of pleats which are uniform. Particularly, in the manufacture of draperies there arises the need to make a series of uniform pleat groups in which each group has two, or more often three pleats.

This invention relates to a device which can be used to form uniform pleats and pleat groups.

Heretofore, the operations of pleating draperies and other fabric articles have been necessarily performed by skilled sewing operators, and with tedious repeat measurements and marking. Using the device of the subject invention, it is possible for a relatively unskilled operator to make uniform pleats by just holding and pressing material against preset blades and surfaces of the device. No measuring or marking of pleat lines is required.

According to a preferred embodiment of the invention, the pleat forming device comprises a base means, and a blade supported by said base means in predetermined spaced-apart relation to a reference surface, said blade having an edge defining a corresponding fold line in sheet material to be pleated when such sheet material is held against said blade. The reference surface can be in certain cases the top of a table to which the base means of the device is attached, or in other cases can be the upper surface of a base plate which can be considered part of the base means allowing the device to simply rest on a flat surface without connection thereto.

Expediently the invention provides a slotted plate means secured to the base means in underlying relation to the blade supported thereby, and in overlying relation to the reference surface whether it be a table top or separate base plate. In certain embodiments of the invention the slotted plate means is of a size as to serve as a support base for the entire device, in which cases a separate base plate can be omitted. The slotted plate means is disposed to accommodate insertion of the blade endwise into the opening of preformed pleating loops of the sheet material, and to retain portions of the material adjacent such loops between the slotted plate means and said reference surface.

In the typical use of the device, the pleating loop is pulled up until the stitching line of the loop is parallel with the lower surfaces of the slotted plate means and is centered in the slot thereof, and centered with respect to the blade. This allows a symmetrical placement of the loop about the blade. The top of the loop is then pushed down against the upper edge of the blade and the outwardly bulged portions of the loop are pressed flat against the sides of the blade and top of the slotted plate means. This defines the fold lines of a group of three pleats, all without the need for any measuring or marking by an operator.

The invention includes an embodiment in which a pair of additional blades are used in cooperation with the aforementioned blade. These additional blades are moveable and are each disposed along a corresponding side of the primary or central blade which is stationary. The additional blades are pivotable toward and away from the sides of the stationary blade and the pleating loop material is tucked between the pivotable blades and stationary blade such that the outer edges of the pivotable blades define respective additional fold lines in the sheet material when same is held thereagainst.

For a better understanding of the invention and its various advantages, reference should be had to the following detailed description and accompanying drawings which together exemplify certain preferred embodiments of the invention.

DESCRIPTION OF PREFERRED EMBODIMENTS OF THE INVENTION

Figure 1:
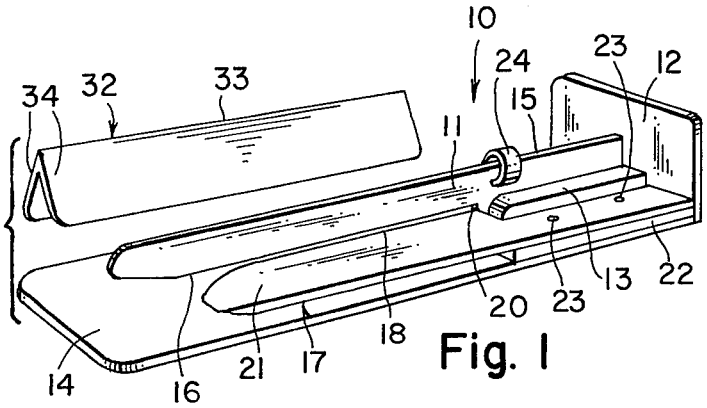
FIG. 1 is a perspective view of a pleat forming device according to a preferred embodiment of the invention.

FIGS. 1–4 exemplify a pleat forming device 10 which generally comprises a base means and a blade 11. The base means includes a back support plate 12 and blade stabilizers 13 which are connected to blade 11, and a base plate 14. Such base means, and particularly the back plate 12 and stabilizers 13, serves to support the blade 11 in a predetermined, spaced-apart, generally perpendicular relation to a reference surface, which in this embodiment is the top of base plate 14.

Figure 4:
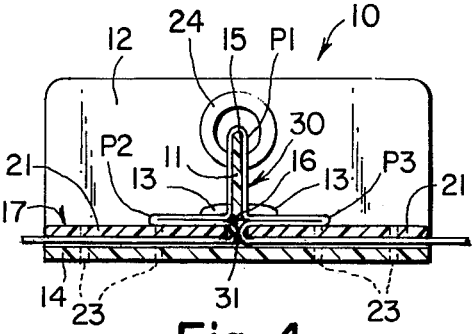
FIG. 4 is a transverse cross-sectional view of the pleat forming device of FIGS. 1–3, taken along line 4—4 of FIG. 2 and showing how the device is used to form pleats in drapery material having pre-sewn pleating loops.
Figure 2:
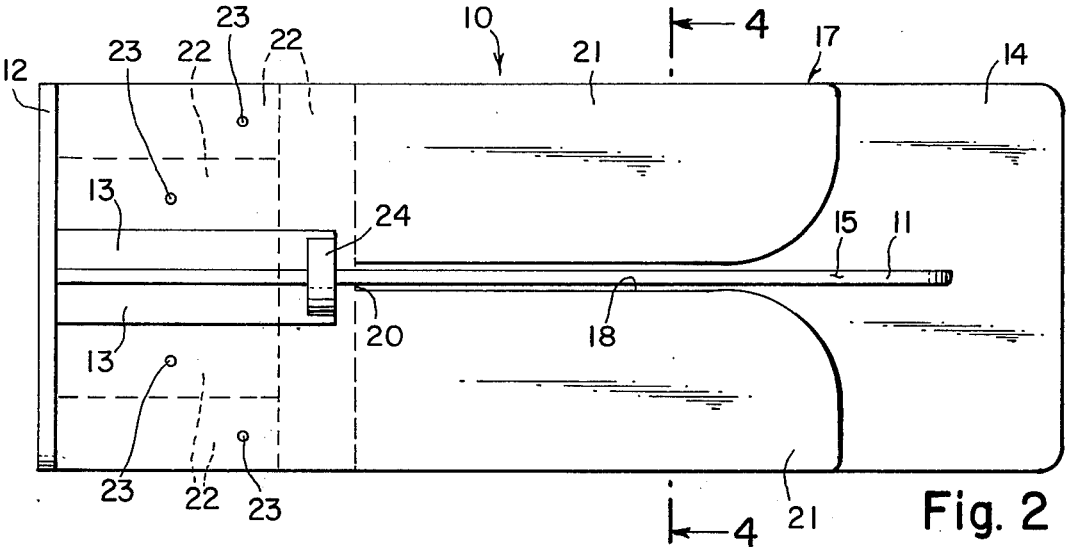
FIG. 2 is a top view of the pleat forming device shown in FIG. 1.
Figure 3:
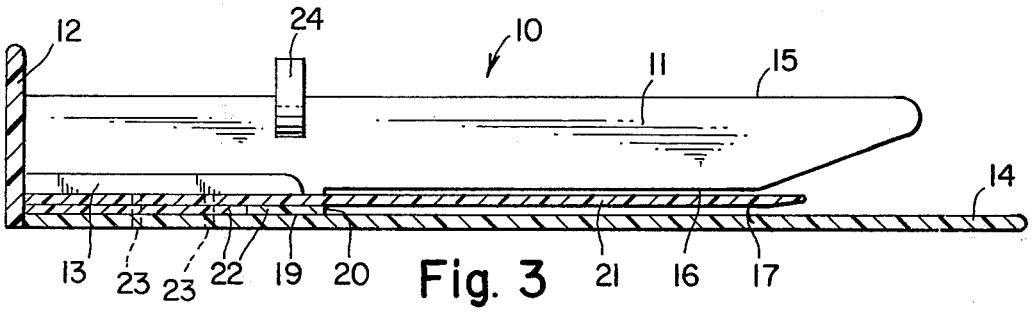
FIG. 3 is a side elevation view, partly in section, of the pleat forming device shown in FIG. 1.

Blade 11 has an upper edge 15 and a lower edge 16, of which upper edge 15 defines a corresponding fold line in sheet material to be pleated when such sheet material is held against blade 11, as better seen from FIG. 4.

Device 10 expediently includes a slotted plate means 17 that is secured to the base means in underlying relation to the blade 11 and in overlying relation to the top of plate 14. Plate 17 has a slot 18 aligned with blade 11, and the plate means 17 is spaced a small distance above plate 14, such spacing and slot 18 being disposed to accommodate insertion of blade 11 endwise into preformed pleating loops of drapery sheet material;

and to retain portions of the material adjacent such loops between plates 14 and 17.

Blade 11 is provided with a bottom edge 19 below edge 16, and which sets against plate 14, and a shoulder 20.

Plate means 17 is expediently made from a pair of plates 21 arranged on respective opposite sides of blade 11. Shims 22 maintain a selected spacing of plates 21 above plate 14, to accommodate the thickness of material to be pleated.

The various parts of device 10 are suitably made of plastic, and can be assembled with cement or any other conventional fastening means. By way of example, plates 21 are connected to respective stabilizers 13 by threaded fasteners or pins received in aligned holes 23 of such parts 21 and 13. The aforesaid fastening means also connects base plate 14 to plates 21 and stabilizers 13, plate 14 being provided with similarly aligned holes, as well as additional holes that can accommodate screw fasteners, in case it is desired to secure the device 10 to a table or other support.

Because the distance of the blade upper edge 15 from the top of base plate 14 sets the size of the pleats formed by the device 10, it is desirable to make the device 10 so that it can accommodate different sizes of blade 11. For such purpose, the back plate 12, blade 11, stabilizers 13 and a thumb support ring 24 are permanently connected together as a subassembly, so that whenever a different size blade 11 is needed, such blade subassembly is replaced with an appropriate sized subassembly.

In the use of the device 10, sheet material can be simply passed under the plates 21, through the slot 18 and around blade 11, the upper edge 15 of which will define the center crease or fold line of a single pleat, and the edges of plates 21 adjacent slot 18 will define the bottom fold lines of such pleat.

However, the device 10, as illustrated in FIG. 4 can be used to make groups of three pleats each on drapery material having pre-sewn pleating loops. To do this, the free end of blade 11 is inserted into the opening of a pleating loop 30 and the portions of drapery material adjacent the loop 30, on each side of stitching line 31, are slipped underneath plates 21 and advanced until the edge of the material comes against a stop defined by one of the shims 22. Loop 30 is pulled up until stitching line 31 is parallel with the lower surfaces of plates 17 and is centered in slot 18, and with respect to blade 11. This allows the loop 30 to be positioned symmetrically about blade 11. The top of the loop 30 is then pushed down against the upper edge 15 of blade 11 and the outwardly bulged portions of the loop 30 are pressed flat against the sides of blade 11 and the tops of plates 21. Such pressing serves to define the fold lines of a group of three pleats P1, P2 and P3. As indicated in FIG. 4, the outer pleats P2, P3 of the group are swung up flat against the center pleat P1. The pleat group P1, P2, P3 is then slipped off the device 10, which is conveniently held back by thumb pressure against ring 24 while the material is pulled. The group of pleats P1, P2, P3 can then be pinned, tack sewn or clipped together in a conventional manner.

To aid in forming pleats, there is provided a crease forming member 32 having a central fold line 33 and pivotable wings 34 arranged to press the material against the edge 15 and sides of blade 11. Crease forming member 32 is expediently made of cardboard or flexible plastic and is manually pressed over the material laid around blade 11.

Figure 5:
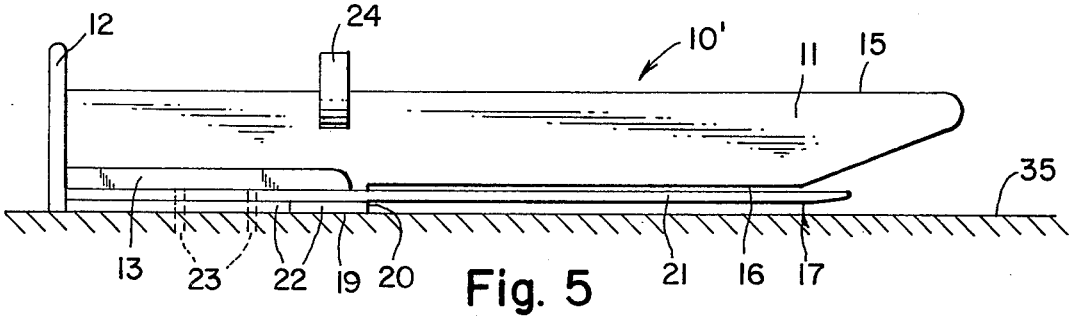
FIG. 5 is a side elevation view, similar to FIG. 3 of a pleat forming device according to another embodiment of the invention which is fastened to a table surface for support thereby instead of having a self-supporting base plate.
Figure 6:
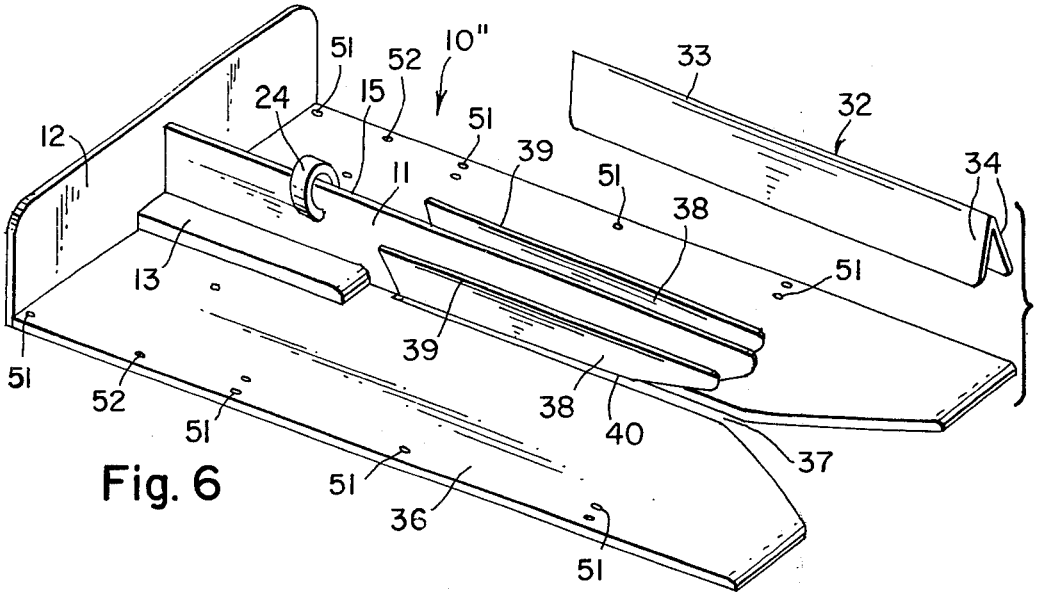
FIG. 6 is a perspective view of a pleat forming device according to another embodiment of the invention.
Figure 7:
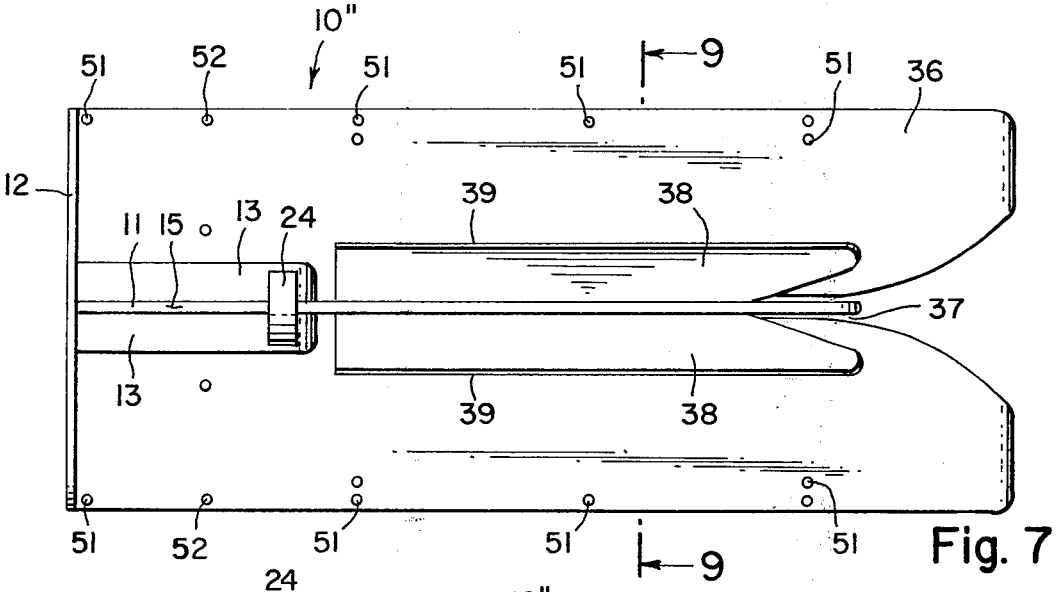
FIG. 7 is a top view of the pleat forming device shown in FIG. 6.
Figure 8:
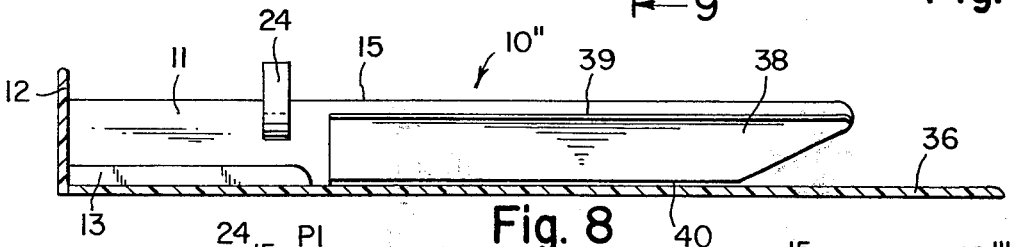
FIG. 8 is a side elevation view, partly in section, of the pleat forming device shown in FIG. 6.
Figure 9:
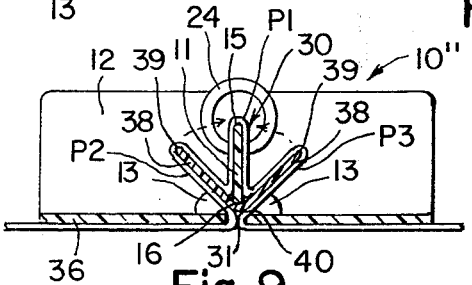
FIG. 9 is a transverse cross-sectional view of the pleat forming device of FIGS. 6–8, taken along line 9—9 of FIG. 7 and showing how the device is used to form pleats in drapery material having pre-sewn pleating loops.

In FIG. 5 is shown a pleat forming device 10' which is similar to and operates substantially in the same manner as device 10, except that the device 10' is fastened directly to a flat support surface 35, such as the top of a table. The surface 35 is thus the reference surface for alignment of the blade 11. Because the device 10' is fastened directly on surface 35, the base plate 14 is not really needed, and therefore is omitted.

FIGS. 6–9 exemplify a pleat forming device 10'' which is similar generally to the device 10 and operates similarly thereto. In device 10'' the base plate 14 and slotted plate means 17 of the device 10 are replaced by a unitary slotted base plate 36 to which the blade 11, back plate 12 and stabilizers 13 are connected, expediently by cement. Slot 37 in plate 36 serves the same function as slot 18 between plates 21 of plate means 17.

However, device 10'' includes a pair of additional blades 38 each disposed along a corresponding side of the central stationary blade 11 for pivotal movement relative thereto.

Edges 39 of blades 38 define respective additional fold lines in the pleating loop material when same is held thereagainst. Blades 38 are expediently made by folding a pre-cut piece of cardboard or plastic along a central line 40 of symmetry and securing the integrally connected pair of blades 38 to the lower edge 16 of blade 11 along line 40, as with cement.

In the device 10'', the blade 11 is generally perpendicular to the slotted base plate 36 and extends in overlying relation to slot 37, whereas the edges 39 of blades 38 are generally parallel to blade 11 and its edge 15.

Figure 10:
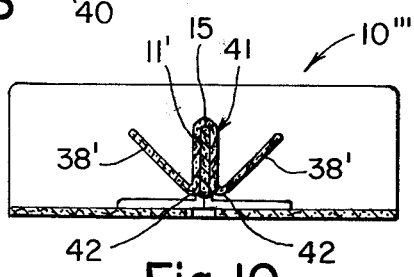
FIG. 10 is a transverse cross-sectional view, similar to FIG. 9, but of a pleat forming device according to a further embodiment of the invention, in which all three blades are integrally connected to accommodate fabrication from cardboard and like materials.

FIG. 10 shows a pleat forming device 10''' which is basically identical in working parts and operation to the device 10'', but which is fabricated out of cardboard. In device 10''' there is a stationary blade 11' a part of which is formed by a folded piece 41 that also defines the pivotable blades 38'. Thus, blades 38' are integrally connected to the stationary blade 11' about respective fold lines 42.

In the operation of devices 10'' and 10''', the pivotable blades 38, 38' are held flat against the stationary blade 11, or 11' until the pleating loop 30 is fully inserted and symmetrically placed. When the top of the loop 30 is pushed against the upper edge 15 of blade 11, or 11', the outwardly bulged portions of the loop are tucked in between blades 38, 38' and blade 11, or 11' to form pleats P1, P2, P3 as better seen from FIG. 9.

Crease forming member 32 can be used in conjunction with each of the pleat forming devices 10, 10', 10'', 10''', as desired or the laying of material against blades 11, 11', 38, 38' can be purely manual.

to enhance the usefulness of the pleat forming devices 10'', 10''' the slotted base plate 36 is provided with a series of spaced holes 51 that can be used to mark drapes with a pencil inserted through such holes 51 to locate precisely on the drapes where pleats are to be sewn. Another series of spaced holes 52 is provided in plate 36 for pencil marking of scallop cutting lines in drapes. To use the scallop marking holes 52, a pin is inserted through one hole 52 at a time and a pencil through an adjacent hole 52, and the plate 36 is swung to function as a compass.

The spacing of the holes 51 is set in accordance with the pleat size and spacing as established by the height of upper edge 15 of blade 11 above the lower surface of plate 36, to establish the desired fullnesses of the finished drape, such 3½, 3, 2½, 2 to 1 ratios.

From the foregoing description of the invention, it will become apparent to the artisan that the invention is adapted to numerous modifications and variations as will become obvious from the examples disclosed herein.

What is claimed is:

1. A pleat forming device which comprises a base means, a blade supported by said base means in predetermined spaced-apart relation to a reference surface, said blade having an edge defining a corresponding fold line in sheet material to be pleated when such sheet material is held against said blade, a slotted plate means secured to said base means in underlying relation to said blade and in overlying relation to said reference surface, said slotted plate means being disposed to accommodate insertion of said blade endwise into preformed pleating loops of the sheet material and to retain portions of the material adjacent such loops between the slotted plate means and said reference surface.

2. A pleat forming device according to claim 1 including a crease forming member having a fold line and pivotable wings arranged to press said sheet material against the edge and sides of said blade.

3. A pleat forming device according to claim 1 wherein said base means includes a base plate positioned in underlying relation to said slotted plate means, the upper surface of said base plate facing said slotted plate means and being said reference surface.

4. A pleat forming device according to claim 1 including a stop member positioned for engagement with an edge of said sheet material to limit the insertion distance of said blade into the pleating loops.

5. A pleat forming device according to claim 1 wherein said blade supported by the base means is stationary and including a pair of additional blades each disposed along a corresponding side of said stationary blade for pivotal movement relative thereto, edges of said additional blades defining respective additional fold lines in said sheet material when same is held thereagainst.

6. A pleat forming device according to claim 5 wherein said stationary blade is generally perpendicular to said slotted plate means and said edges of the additional blades are generally parallel to said edge of the stationary blade.

7. A pleat forming device according to claim 5 wherein said stationary blade and the additional blades are integrally connected about respective fold lines.

8. A pleat forming device according to claim 1 wherein said blade is supported by said base means in generally perpendicular relation to said slotted plate means.

9. A pleat forming device which comprises plate means disposed to define an elongated slot, a blade supported in overlying relation to said slot and having an edge defining a corresponding fold line in sheet material to be pleated when such sheet material is held against said blade, said plate means and slot being positioned to accommodate insertion of said blade endwise into preformed pleating loops of the sheet material and said plate means being positioned to overly portions of the material adjacent such loops.

* * * * *